United States Patent [19]

Das et al.

[11] Patent Number: 4,938,809

[45] Date of Patent: Jul. 3, 1990

[54] SUPERPLASTIC FORMING CONSOLIDATED RAPIDLY SOLIDIFIED, MAGNESTUM BASE METAL ALLOY POWDER

[75] Inventors: Santosh K. Das, Randolph; Chin-Fong Chang, Morris Plains; Derek Raybould, Denville, all of N.J.

[73] Assignee: Allied-Signal Inc., Morris Township, Morris County, N.J.

[21] Appl. No.: 197,796

[22] Filed: May 23, 1988

[51] Int. Cl.[5] ..... C22C 23/02

[52] U.S. Cl. ..... 148/406; 75/249; 420/405; 420/407; 420/408; 420/409; 420/410; 420/411; 420/412; 420/902

[58] Field of Search ..... 420/402, 405, 406, 407, 420/408, 409, 410, 411, 412, 902; 75/249; 148/11.5 M, 11.5 P, 420, 406

[56] References Cited

U.S. PATENT DOCUMENTS 2,659,133 11/1953 Leontis et al. ..... 420/407

FOREIGN PATENT DOCUMENTS 166917 1/1986 European Pat. Off. ..... 420/408
219628 4/1987 European Pat. Off.
222669 7/1968 U.S.S.R. ..... 420/405
533719 2/1941 United Kingdom ..... 420/405
1094237 12/1967 United Kingdom ..... 420/405

OTHER PUBLICATIONS

"Rare Metals Improve Magnesium Alloys", The Iron Age, Jul. 22, 1948, p. 83.

*Primary Examiner*—Robert McDowell
*Attorney, Agent, or Firm*—Ernest D. Buff; Gerhard H. Fuchs; Richard C. Stewart

[57] ABSTRACT

A complex part composed of rapidly solidified magnesium base metal alloy is produced by superplastic forming at a temperature ranging from 160° C. to 275° C. and at a rate ranging from 0.00021 m/sec. to 0.00001 m/sec., to improve the formability thereof and allow forming to be conducted at lower temperatures. The rapidly solidified magnesium based alloy has a composition consisting essentially of the formula $Mg_{bal}Al_aZn_bX_c$, wherein X is at least one element selected from the group consisting of manganese, cerium, neodymium, praseodymium and yttrium, "a" range from 0 to about 15 atom percent, "b" ranges from 0 to about 4 atom percent and "c" ranges from about 0.2 to 3 atom percent, the balance being magnesium and incidental impurities, with the proviso that the sum of aluminum and zinc present ranges from about 2 to 15 atom percent. Such an alloy contains fine grain size and finely dispersed magnesium-, aluminum- rare earth intermetallic phases. When formed, the part exhibits good corrosion resistance together with high ultimate tensile strength and good at room ductility temperature, which properties are, in combination, far superior to those of conventional magnesium alloys. The part is suitable for application as a structural member in helicopters, missiles and air frames where good corrosion resistance in combination with high strength and ductility is important.

4 Claims, 4 Drawing Sheets

SUPERPLASTIC FORMING CONSOLIDATED RAPIDLY SOLIDIFIED, MAGNESTUM BASE METAL ALLOY POWDER

1. FIELD OF INVENTION

This invention relates to a method of superplastic forming (extrusion, forging, and rolling, etc.) of bulk articles made by consolidation of the powder of rapidly solidified magnesium base metal alloys, to achieve a combination of good formability to complex net shapes and good mechanical properties of the articles. The superplastic forming allows deformation to net shapes.

2. DESCRIPTION OF THE PRIOR ART

Magnesium alloys are considered attractive candidates for structural use in aerospace and automotive industries because of their light weight, high strength to weight ratio, and high specific stiffness at both room and elevated temperatures. Although magnesium has reasonable corrosion properties under regular atmospheric conditions, it is susceptible to attack by chloride containing environments. Furthermore, the high chemical reactivity of magnesium, as represented by its extreme position in the electrochemical series and its inability to form a protective, self-healing, passive film in corrosive environments, makes magnesium alloys vulnerable to galvanic attack when coupled with more noble metals. In addition to the galvanic coupling between the structural members, localized corrosion may occur due to inhomogenities within the magnesium alloy that act as electrodes for galvanic corrosion. This poor corrosion resistance of magnesium has been a serious limitation, preventing wide scale use of magnesium alloys.

The application of rapid solidification processing (RSP) in metallic system results in the refinement of grain size and intermetallic particle size, extended solid solubility, and improved chemical homogeneity. By selecting the thermally stable intermetallic compound ($Mg_2Si$) to pin the grain boundary during consolidation, a significant improvement in the mechanical strength [0.2% yield strength (Y.S.) up to 393 MPa, ultimate tensile strength (UTS) up to 448 MPa, elongation (El.) up to 9%] can be achieved in RSP, Mg-Al-Zn-Si-Zn alloys, [S. K. Das, et al. U.S. Pat. No. 4,675,157, High Strength Rapidly Solidified Magnesium Base Metal Alloys, June 1987]. A previous invention (Invention record P.D. 82-2487, Ser. No. 781,620) discloses that addition of rare earth elements (Y, Nd, Pr, Ce) to Mg-Al-Zn alloys further improves corrosion resistance (11 mdd when immersed in 3% NaCl aqueous solution for $3.4\times10^5$ sec. at 27° C.) and mechanical properties (Y.S. up to 435 MPa, U.T.S. up to 476 MPa, El. up to 14%) of magnesium alloys. The alloys are subjected to rapid solidification processing by using a melt spin casting method wherein the liquid alloy is cooled at a rate of $10^{5°}$ to $10^{7°}$ C./sec while being solidified into a ribbon or sheet. That process further comprises the provision of a means to protect the melt puddle from burning, excessive oxidation and physical disturbance by the air boundary layer carried with the moving substrate. The protection is provided by a shrouding apparatus which serves the dual purpose of containing a protective gas such as a mixture of air or $CO_2$ and $SF_6$, a reducing gas such as. CO or an inert gas, around the nozzle while excluding extraneous wind currents which may disturb the melt puddle. The as cast ribbon or sheet is typically 25 to 100 μm thick. The rapidly solidified ribbons are sufficiently brittle to permit them to be mechanically comminuted by conventional apparatus, such as a ball mill, knife mill, hammer mill, pulverizer, fluid energy mill. The comminuted powders are either vacuum hot pressed to about 95% dense cylindrical billets or directly canned to similar size. The billets or cans are then hot extruded to round or rectangular bars at an extrusion ratio ranging from 14:1 to 22:1.

Magnesium alloys, like other alloys with hexagonal crystal structures, are much more workable at elevated temperatures than at room temperature. The basic deformation mechanisms in magnesium at room temperature involve both slip on the basal planes along <1,1,2,0> directions and twinning in planes {1,0,1,2} and <1,0,-1,1> direction. At higher temperatures (>225° C.), pyramidal slip {1,0,−1,1 }<1,1,2,0> becomes operative. The limited number of slip systems in the hcp magnesium presents plastic deformation conformity problems during working of a polycrystalline material. This results in cracking unless substantial crystalline rotations of grain boundary deformations are able to occur. For the fabrication of formed magnesium alloy parts, the temperature range between the minimum temperature to avoid cracking and a maximum temperature to avoid softening is quite narrow. The forgeability of conventional processed magnesium alloys depends on three factors: the solidus temperature of the alloy, the deformation rate, and the grain size. Magnesium alloys are often forged within 55° C. (100° F.) of their solidus temperature [Metals Handbook, Forming and Forging, Vol. 14, 9th ed., ASM International, 1988, pp. 259–260]. An exception is the high-zinc alloy ZK60, which sometimes contains small amounts of the low -melting eutectic that forms during ingot solidification. Forging of this alloy above about 315° C. (600° F.)—the melting point of the eutectic—can cause severe rupturing. The problem can be minimized by holding the cast ingot for extended periods at an elevated temperature to dissolve the eutectic and to restore a higher solidus temperature. The mechanical properties developed in magnesium forgings depend on the strain hardening induced during forging. Strain hardening can be achieved by keeping the forging temperature as low as practical: however, if temperatures are too low, cracking will occur. Work on metalworking of formed magnesium parts made from rapidly solidified magnesium alloys is relatively rare. Busk and Leontis [R. S. Busk and T. I. Leontis, "The Extrusion of Powdered Magnesium Alloys," *Trans. AIME.* 188 (2) (1950), pp. 297–306] investigated hot extrusion of atomized powder of a number of commercial magnesium alloys in the temperature range of 316° C. (600° F.)–427° C. (800° F.). The as-extruded properties of alloys extruded from powder were not significantly different from the properties of extrusions from permanent mold billets. In the study reported by Isserow and Rizzitano [S. Isserow and F. J. Rizzitano, "Microquenched Magnesium ZK60A Alloy," *Inten'l J. of Powder Metallurgy and Powder Technology,* 10 (3) (1974), pp. 217–227.] on commercial ZK60A magnesium alloy powder made by a rotating electrode process extrusion temperatures varying from ambient to 371° C. (700° F.) were used. The mechanical properties of the room temperature extrusions were significantly better than those obtained by Busk and Leontis but those extruded at 121° C. (250° F.) did not show any significant difference between the conventionally processed and rapidly solidified material. However, care must be exercised in comparing their mechanical properties in the longitudinal direction from room temperature extrusions since they observed significant delamination on the fracture surfaces and properties may be highly inferior in the transverse direction.

There remains a need in the art for the economic production of complex net shape articles consolidated from rapidly solidified magnesium alloys, particularly containing uniform dispersions of intermetallic compounds that provide the alloys with good corrosion resistance combined with high strength and good ductility.

SUMMARY OF THE INVENTION

The present invention provides a metal complex net shape article fabricated from a high strength, corrosion resistant magnesium based alloy. The alloy is rapidly solidified into ribbon or powder and which is especially suited for consolidation into bulk shapes having a fine microstructure. Generally stated, the alloy has a composition consisting essentially of the formula $Mg_{bal}Al_aZn_bX_c$, wherein X is at least one element selected from the group consisting of manganese, cerium, neodymium, praseodymium, yttrium and silver, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent.

The magnesium alloys used in the forming of the present invention are subjected to rapid solidification processing by using a melt spin casting method wherein the liquid alloy is cooled at a rate of $10^{5°}$ to $10^{7°}$ C./sec while being formed into a solid ribbon or sheet. That process further comprises the provision of a means to protect the melt puddle from burning, excessive oxidation and physical disturbance by the air boundary layer carried with the moving substrate. Said protection is provided by a shrouding apparatus which serves the dual purpose of containing a protective gas such as a mixture of air or $CO_2$ and $SF_6$, a reducing gas such as CO or an inert gas, around the nozzle while excluding extraneous wind currents which may disturb the melt puddle.

The alloy elements manganese, cerium, neodymium, praseodymium, yttrium and silver, upon rapid solidification processing, form a fine uniform dispersion of intermetallic phases such as $Mg_3Ce$,$Al_2Nd$,$Mg_3Pr$,$Al_2Y$, depending on the alloy composition. These finely dispersed intermetallic phases increase the strength of the alloy and help to maintain a fine grain size by pinning the grain boundaries during consolidation of the powder at elevated temperature. The addition of the alloying elements aluminum and zinc contributes to strength via matrix solid solution strengthening and by formation of certain age hardening precipitates such as $Mg_{17}Al_{12}$ and MgZn.

The forming of the present invention is produced from a consolidated metal alloy article. Consolidation of the article is made by compacting powder particles of the magnesium based alloy with or without canning, and degassing. The powder particles can be warm pressed by heating in a vacuum to a pressing temperature ranging from 150° C. to 275° C., which minimizes coarsening of the dispersed, intermetallic phases. These powder particles can be formed into bulk shapes using conventional methods such as extrusion. The present invention provides a method of metal working of formed magnesium parts to complex net shape by forging and superplastic forming (at a rate ranging from 0.00021 m/sec to 0.00001 m/sec, and at a temperature ranging from 160° C. to 275° C.).

Consolidated metal articles made from magnesium based alloys by the process described herein above exhibit good corrosion resistance (i.e. corrosion rate of less than 50 mils per year when immersed in a 3 percent NaCl aqueous solution at 25° C. for 96 hours) together with high ultimate tensile strength [up to 513 MPa (74.4 ksi)] and good ductility (i.e. >5 percent tensile elongation) at room temperature. These properties present in superplastic formings produced from the consolidated articles, are, in combination, far superior to those of conventional magnesium alloy. The formings are suitable for applications as structural members in helicopters, missiles and air frames where good corrosion resistance in combination with high strength and ductility is important.

BRIEF DESCRIPTION OF THE DRAWINGS

The invention will be more fully understood and further advantages will become apparent when reference is made to the following detailed description and the accompanying drawings, in which:

FIG. 1(*b*) is a transmission electron micrograph of as-cast ribbon of the alloy $Mg_{91}Zn_2Al_5Y_2$;

FIG. 2(*b*) is a transmission electron micrograph of as-extruded bulk compact of alloy $Mg_{91}Zn_2Al_5Y_2$ illustrating fine grain and dispersoid size retained after compaction: and FIG. 3(*a*) is a macrograph of a forging consolidated from an alloy $Mg_{92}Zn_2Al_5Nd_1$ at a temperature of 180° C. and at a moderate rate:

FIG. 3(*b*) is a macrograph of a forging consolidated from an alloy $Mg_{92}Zn_2Al_5Nd_1$ at a temperature of 160° C. and at a low rate illustrating the effect of strain rate on the superplastic formability of the alloy; and FIG. 4 is a plot depicting the percentage weight loss of several alloys exposed to a salt spray, corrosive environment as a function of exposure time.

DETAILED DESCRIPTION OF THE INVENTION AND THE PREFERRED EMBODIMENTS

In accordance with the present invention a forming is produced from an article consolidated from a rapidly solidified alloy. The alloy consists essentially of nominally pure magnesium alloyed with about 0 to 15 atom percent aluminum, about 0 to 4 atom percent zinc, about 0.2 to 3 atom percent of at least one element selected from the group consisting of manganese, cerium, neodymium, praseodymium, and yttrium the balance being magnesium and incidental impurities, with the proviso that the sum of aluminum and zinc present ranges from about 2 to 15 atom percent. The alloy is melted in a protective environment; and quenched in a protective environment at a rate of at least about $10^{5°}$ C./sec by directing the melt into contact with a rapidly moving chilled surface to form thereby a rapidly solidified ribbon. Such alloy ribbons have high strength and high hardness (i.e. microVickers hardness of at least about 125 kg/mm$^2$). When aluminum is alloyed without addition of zinc, the minimum aluminum content is preferably above about 6 atom percent.

The alloys of the consolidated article from which the forming of the invention is produced have a very fine microstructure which is not resolved by optical micrograph. Transmission electron micrograph reveals a substantially uniform cellular network of solid solution phase ranging from 0.2–1.0 μm in size, together with precipitates of very fine, binary or ternary intermetallic phases which are less than 0.1 μm and composed of magnesium and other elements added in accordance with the invention.

The mechanical properties [e.g. 0.2% yield strength (YS) and ultimate tensile strength (UTS)] of the alloys of this invention are substantially improved when the precipitates of the intermetallic phases have an average size of less than 0.1 μm, and even more preferably an average size ranging from about 0.03 to 0.07 pm . The presence of intermetallic phases precipitates having an average size less than 0.1 μm pins the grain boundaries during consolidation of the powder at elevated temperature with the result that a fine grain size is substantially maintained during high temperature consolidation.

Figure 1A:
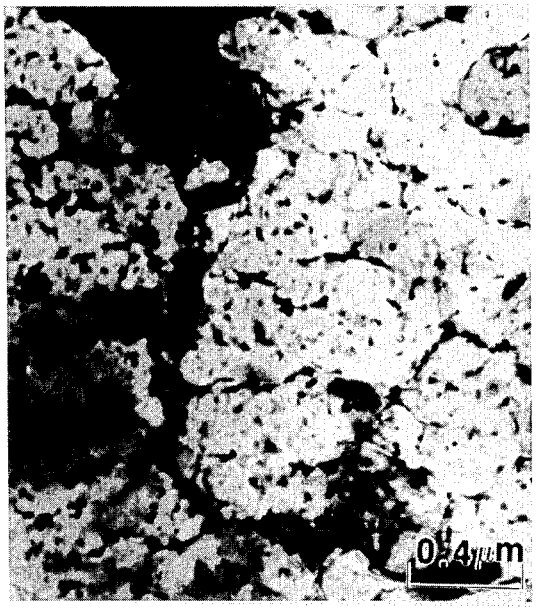
FIG. 1(*a*) is a transmission electron micrograph of as-cast ribbon of the alloy $Mg_{92}Zn_2Al_5Ce_1$ illustrating the fine grain size and precipitates thereof.
Figure 1B:
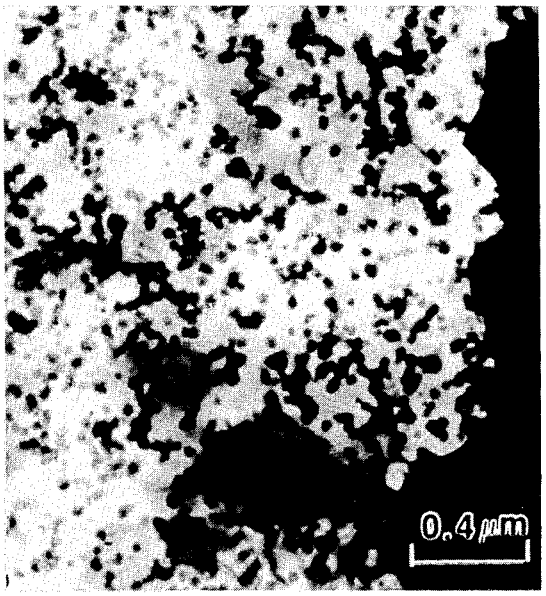

In FIGS. 1(*a*) and 1(*b*) there are illustrated the microstructures of ribbon cast from alloys consisting essentially of the compositions $Mg_{92}Zn_2Al_5Ce_1$ and $Mg_{91}Zn_2Al_5Y_2$, respectively. The microstructures shown are typical of samples solidified at cooling rate in excess of $10^5$° C./sec and is responsible for high hardness ranging from 140–200 kg/mm$^2$. The high hardness of Mg-Al-Zn-X alloys can be understood by the fine microstructure observed in as-cast ribbons. The as-cast microstructure of alloys containing Ce, Pr and Nd are very similar and show a cellular microstructure with precipitation of $Mg_3X$ (X=Ce, Pr) both inside the cell and at cell boundaries (FIG. 1*a*). The alloy containing Y and Nd shows fine spherical precipitates of $Al_2X$(X=Y, Nd) dispersed uniformly throughout (FIG. 1*b*).

The as cast ribbon or sheet is typically 25 to 100 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained Usually the powder comprises of platelets having an average thickness of less than 100 μm. These platelets are characterized by irregular shapes resulting from fracture of the ribbon during comminution.

The powder can be consolidated into fully dense bulk parts by known techniques such as hot isostatic pressing, hot rolling, hot extrusion, hot forging, cold pressing followed by sintering, etc. Typically, the comminuted powders of the alloys are either vacuum hot pressed to cylindrical billets with diameters ranging from 50 mm to 110 mm and length ranging from 50 mm to 140 mm or directly canned up to 280 mm in diameter. The billets or cans are then hot extruded to round or rectangular bars having an extrusion ratio ranging from 14:1 to 22:1 at a rate ranging from 0.00021 m/sec to 0.00001 m/sec. Generally, each of the extruded bars has a thickness of at least 6 mm measured in the shortest dimension, and is capable of being subsequently hot rolled to 1 mm thick plate. The extrusion temperature normally ranges from 150° C. to 275° C. The extruded bars can also be fabricated into complex smooth shape with a thickness of at least 1 mm measured along the shortest direction by superplastic forming at a rate ranging from 0.00021 m/sec to 0.00001 m/sec. The superplastic forming temperature ranges from 160° C. to 275° C. It was surprisingly found that superplastic forming of this hcp metal is possible and that superplastic forming of these alloys allows lower forming/forging temperatures than conventional forming/forging temperatures.

The microstructure obtained after consolidation depends upon the composition of the alloy and the consolidation conditions. Excessive times at high temperatures can cause the fine precipitates to coarsen beyond the optimal submicron size, leading to a deterioration of the properties, i.e. a decrease in hardness and strength. Hence, the ability of superplastic forming at lower temperatures than conventional forming offers the opportunity to refine the microstructure and increase the strength.

Figure 2A:
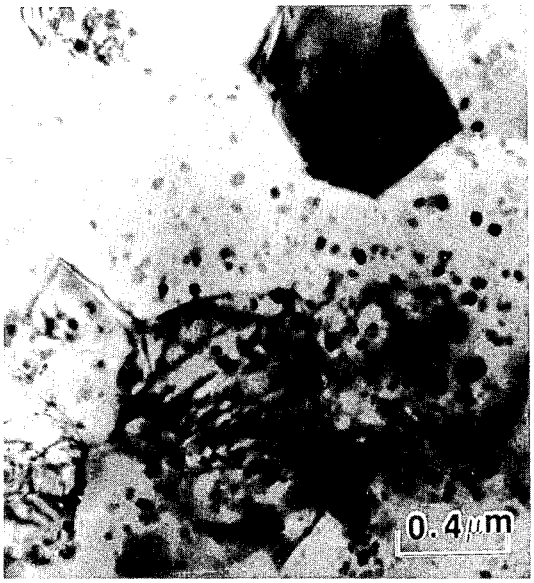
FIG. 2(*a*) is a transmission electron micrograph of as-extruded bulk compact of alloy $Mg_{92}Zn_2Al_5Ce_1$.
Figure 2B:
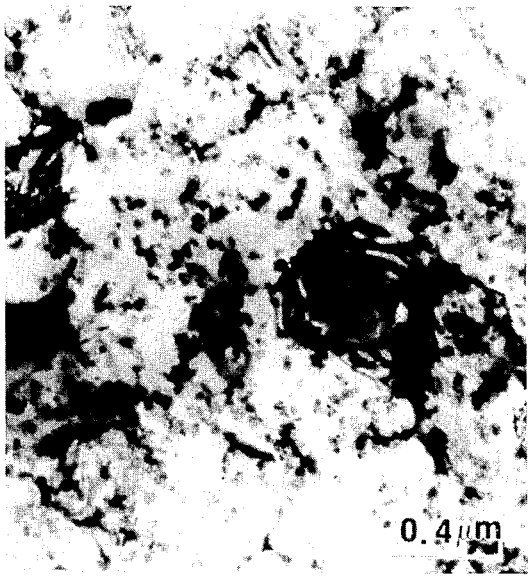

As representatively shown in FIGS. 2(*a*) and 2(*b*) for alloys $Mg_{92}Zn_2Al_5Ce_1$ and $Mg_{91}Zn_2Al_5Y_2$, respectively, the compacted consolidated article of the invention is composed of a magnesium solid solution phase having an average grain size of 0.5 μm, containing a substantially uniform distribution of dispersed intermetallic phase $Mg_3X$ (X=Ce, Pr) $Al_2Nd$, or $Al_2Y$ depending on the alloy and in addition, the microstructure contains aluminum containing precipitates of phase $Mg_{17}Al_{12}$ and zinc containing phase MgZn. Both $Mg_{17}Al_{12}$ and MgZn phases are usually larger than the $Mg_3X$ phase and is 0.5 to 1.0 μm in size depending on the consolidation temperature.

At room temperature (about 20° C.), the compacted, consolidated article has a Rockwell B hardness of at least about 55 and is more typically higher than 65. Additionally, the ultimate tensile strength of the consolidated article from which the forming of the invention is produced is at least about 378 MPa(55 ksi). The high strengths [0.2% YS up to 456 MPa (66.2 ksi) and UTS up to 513 MPa (74.4 ksi)] of the alloys at room temperature, fall to two-thirds [0.2% YS=250–330 MPa (36.3–48.0 ksi) UTS=300–380 MPa (43.6–55.2 ksi)]of their room temperature values when tested at 100° C. and drop to one-third or one-quarter (0.2% YS=1-10–160 MPa (16.0–23.2 ksi), UTS=140–190 MPa (20.3–27.6 ksi)] of their room temperature values on testing at 150° C. These reductions in strength are accompanied by 10–40 fold increases in elongation to fracture at 100° C. (elongation 45–65%) and 150° C. (elongation 190–220%), respectively, and with strength levels at 150° C. comparable with wrought ingot alloys ZK60 and AZ91HP. The mechanical properties of the consolidated article also strongly depend on the strain rate. At a constant temperature increasing the strain rate increases the tensile strength. Moreover, the strain rate dependence of strength increases with increasing temperature. Testing at a high temperature and a low strain rate tends to improve the ductility. Superplastic behavior (elongation >100%) occurred at a test temperature of 150° C. and at a strain rate $<1\times10^{-3}$/sec. in the consolidated article. The combination of low flow stress and high ductility in the alloys makes them exceptionally useful in superplastic forming such as hot rolling and hot forging. When forged in a close die at a low rate, a complex part may be formed in a single step and with outstanding precision of shape and no cracks. The very low flow stress of these alloys at a low strain rate means that such forgings can be produced in light presses at a temperature as low as 160° C.

The following examples are presented in order to provide a more complete understanding of the invention. The specific techniques, conditions, materials and reported data set forth to illustrate the invention are exemplary and should not be construed as limiting the scope of the invention.

EXAMPLE 1

Ribbons samples were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 100 μm thick.

The nominal compositions of the alloys based on the charge weight added to the melt are summarized in Table 1 together with their as-cast hardness values. The hardness values are measured on the ribbon surface which is facing the chilled substrate: this surface being usually smoother than the other surface. The microhardness of these Mg-Al-Zn-X alloys used in the forming of the present invention ranges from 140 to 200 Kg/mm$^2$. The as-cast hardness increases as the rare earth content increases. The hardening effect of the various rare earth elements on Mg-Zn-Al-X alloys is comparable. For comparison, also listed in Table 1 is the hardness of a commercial corrosion resistant high purity magnesium AZ91C-HP alloy. It can be seen that the hardness of the alloys used in the forming of the present invention is higher than commercial AZ91C-HP alloy.

TABLE 1

Microhardness (Kg/mm$^2$) Values of R.S. Mg—Al—Zn—X As Cast Ribbons.

| Sample | Alloy Nominal (At %) | Hardness |
|---|---|---|
| 1 | $Mg_{92.5}Zn_2Al_5Ce_{0.5}$ | 151 |
| 2 | $Mg_{92}Zn_2Al_5Ce_1$ | 186 |
| 3 | $Mg_{92.5}Zn_2Al_5Pr_{0.5}$ | 150 |
| 4 | $Mg_{91}Zn_2Al_5Y_2$ | 201 |
| 5 | $Mg_{88}Al_{11}Mn_1$ | 162 |
| 6 | $Mg_{88.5}Al_{11}Nd_{0.5}$ | 140 |
| 7 | $Mg_{92}Zn_2Al_5Nd_1$ | 183 |
| Alloy Outside The Scope Of The Invention | | |
| Commercial Alloy AZ 91C-HP | ($Mg_{91.7}Al_{8.0}Zn_{0.2}Mn_{0.1}$) | 116 |
| 8 (alloy outside the | | |

TABLE 1-continued

Microhardness (Kg/mm$^2$) Values of R.S. Mg—Al—Zn—X As Cast Ribbons.

| Sample | Alloy Nominal (At %) | Hardness |
|---|---|---|
| present invention) | | |

EXAMPLE 2

Rapidly solidified ribbons were subjected first to knife milling and then to hammer milling to produce −40 mesh powders. The powders were vacuum outgassed and hot pressed at 200°–275° C. The compacts were extruded at temperatures of about 200°–250° C. at extrusion ratios ranging from 14:1 to 22:1. The compacts were soaked at the extrusion temperature for about 20 mins. to 4 hours. Tensile samples were machined from the extruded bulk compacted bars and tensile properties were measured in uniaxial tension at a strain rate of about $5.5\times10^{-4}$/sec at room temperature. The tensile properties together with Rockwell B ($R_B$) hardness measured at room temperature are summarized in Table 2. The alloys show high hardness ranging from 65 to about 81 $R_B$.

Most commercial magnesium alloys have a hardness of about 50 $R_B$. The density of the bulk compacted samples measured by conventional Archimedes technique is also listed in Table 2.

Both the yield strength (YS) and ultimate tensile strength (UTS) of the present alloys are exceptionally high. For example, the alloy $Mg_{91}Zn_2Al_5Y_2$ has a yield strength of 66.2 Ksi and UTS of 74.4 Ksi which is similar to that of conventional aluminum alloys such as 7075, and approaches the strength of some commercial low density aluminum-lithium alloys. The density of the magnesium alloys is only 1.93 g/c.c. as compared with a density of 2.75 g/c.c. for conventional aluminum alloys and 2.49 g/c.c. for some of the advanced low density aluminum lithium alloys now being considered for aerospace applications. Thus, on a specific strength (strength/density) basis the magnesium base alloys provide a distinct advantage in aerospace applications. In some of the alloys ductility is quite good and suitable for engineering applications. For example, $Mg_{91}Zn_2Al_5Y_2$ has a yield strength of 66.2 Ksi, UTS of 74.4 Ksi, and elongation of 5.0%, which is superior to the commercial alloys ZK60A, and AZ91C-HP, when combined strength and ductility is considered. The magnesium base alloys find use in military applications such as sabots for armor piercing devices, and air frames where high strength is required.

TABLE 2

Properties of Rapidly Solidified Mg—Al—Zn—X Alloy Extrusions

| Composition Nominal (AT %) | Density (g/c.c.) | Hardness ($R_B$) | Y.S. MPa (Ksi) | U.T.S. MPa (Ksi) | Elongation (%) |
|---|---|---|---|---|---|
| $Mg_{92.5}Zn_2Al_5Ce_{0.5}$ | 1.89 | 66 | 359 (52.1) | 425 (61.7) | 17.5 |
| $Mg_{92}Zn_2Al_5Ce_1$ | 1.93 | 77 | 425 (61.7) | 487 (70.6) | 10.1 |
| $Mg_{92.5}Zn_2Al_5Pr_{0.5}$ | 1.89 | 65 | 352 (51.1) | 427 (61.9) | 15.9 |
| $Mg_{91}Zn_2Al_5Y_2$ | 1.93 | 81 | 456 (66.2) | 513 (74.4) | 5.0 |
| $Mg_{88}Al_{11}Mn_1$ | 1.81 | 66 | 373 (54.2) | 391 (56.8) | 3.5 |
| $Mg_{92}Zn_2Al_5Nd_1$ | 1.94 | 80 | 436 (63.3) | 476 (69.1) | 13.8 |
| ALLOYS OUTSIDE THE SCOPE OF THE INVENTION | | | | | |
| Commercial Alloy | | | | | |
| ZK 60 A-T5 ($Mg_{97.7}Zn_{2.1}Zr_{0.2}$) | 1.83 | 50 | 303 (43.9) | 365 (52.9) | 11.0 |
| AZ 91 HP-T6 | 1.83 | 50 | 131 (19.0) | 276 (40.0) | 5.0 |

TABLE 2-continued

| Composition Nominal (AT %) | Density (g/c.c.) | Hardness ($R_B$) | Y.S. MPa (Ksi) | U.T.S. MPa (Ksi) | Elongation (%) |
|---|---|---|---|---|---|
| | Properties of Rapidly Solidified Mg—Al—Zn—X Alloy Extrusions | | | | |
| $(Mg_{91.7}Al_{8.0}Zn_{0.2}Mn_{0.1})$ | | | | | |

EXAMPLE 3

The as-cast ribbon and bulk extruded specimens of rapidly solidified Mg-Al-Zn-X alloys were prepared for transmission electron microscopy by combination of jet thinning and ion milling. Quantitative microstructural analysis of selected R.S. Mg-Al-Zn-X as-cast samples, as shown in Table 3, indicates that the fine grain size ranging from 0.36–0.70 μm and fine cell size ranging from 0.09–0.34 μm of magnesium grains have been obtained by rapid solidification process described herein above. The fine dispersoid size of magnesium-rare earth or aluminum-rare earth intermetallic compounds ranging from 0.04–0.07 μm is also obtained. Because of high melting point and limited solid solubility, these fine dispersoids of aluminum-rare earth or magnesium-rare earth intermetallic compounds do not coarsen appreciably during high temperature consolidation and are quite effective in pinning the grain boundaries as illustrated in the micrographs in FIG. 2 and the quantitative results in Table 3 for as-extruded samples. Such fine grain and the dispersoid size lead to significant improvements in the mechanical properties as compared to conventionally processed material, as shown in Example 2.

TABLE 3

TEM Microstructure Analysis of Selected R.S. Mg—Al—Zn—X As-cast and Extruded Samples

| No. | Nominal Composition At (%) | Matrix Grain Size (μm) | Matrix Cell Size (μm) | Precipitate Size (μm) MgZn | Precipitate Size (μm) $Mg_{17}Al_{12}$ | Precipitate Size (μm) $Mg_3X$ (X = Ce,Pr) | Precipitate Size (μm) $Al_2Y$ | Volume Fraction (%) |
|---|---|---|---|---|---|---|---|---|
| 1 | $Mg_{92}Zn_2Al_5Ce_1$(a) | 0.56 | 0.14 | 0.07 | — | 0.04 | — | — |
| 2 | $Mg_{92}Zn_2Al_5Ce_1$(b) | 0.70 | — | 0.56 | 0.56 | 0.04 | — | 2.33 |
| 3 | $Mg_{92.5}Zn_2Al_5Pr_{0.5}$(a) | 0.70 | 0.34 | 0.15 | 0.15 | 0.04 | — | — |
| 4 | $Mg_{92.5}Zn_2Al_5Pr_{0.5}$(b) | 0.70 | — | 0.13 | 0.65 | 0.03 | — | 2.02 |
| 5 | $Mg_{91}Zn_2Al_5Y_2$(b) | 0.36 | — | 0.23 | 0.23 | — | 0.04 | 2.56 |

(a)As-Cast
(b)As-Extruded

EXAMPLE 4

The effect of temperature and strain rate on the tensile properties of the extruded Mg-Al-Zn-X alloys were evaluated in uniaxial tension at a strain rate ranging from about $2\times10^{-5}$–$2\times10^{-3}$/sec and at temperatures ranging from ambient to 150° C. Prior to testing, the samples were held at the testing temperature for 30 mins. As compared to room temperature tensile strength of extruded Mg-Al-Zn-X alloys, Y.S. drops to about 38–41 ksi, U.T.S. drops to 44–48 ksi and elongation increase to 50% when sample tested at 100° C. at a strain rate of $5.5\times10^{-4}$/sec. Additional decrease in tensile strength (Y.S.=16–18 ksi, U.T.S.=21–22 ksi) accompanied with high elongation (elongation=200%) occurred when sample tested at 150° C. The superplastic behavior (elongation 100%) of these rare earth containing alloys is due to the fine grain and dispersoid size obtained by the rapid solidification process.

TABLE 4

Elevated Temperature Tensile Properties of As-Extruded R.S. Mg—Zn—Al—X Alloy (Strain Rate $5.5\times10^{-4}$/sec.)

| No. | Composition Nominal (At %) | Test Temp. (°C.) | Y.S. MPa (ksi) | U.T.S. MPa (ksi) | Elong (%) |
|---|---|---|---|---|---|
| 1 | $Mg_{91}Zn_2Al_5Y_2$ | 100 | 287 (41.7) | 330 (47.9) | 52.3 |
| | | 150 | 110 (16.0) | 148 (21.5) | 219.7 |
| 2 | $Mg_{92}Zn_2Al_5Nd_1$ | 50 | 395 (57.4) | 444 (64.5) | 28.4 |
| | | 100 | 258 (37.5) | 305 (44.3) | 50.3 |
| | | 150 | 125 (18.2) | 153 (22.2) | 199.8 |

The tensile properties of the consolidated article also strongly depend on the strain rate, Table 5. At a constant temperature increasing the strain rate increases the tensile strength. Moreover, the strain rate dependence of strength increases with increasing temperature. Testing at a high temperature and at a low strain rate tends to improve the ductility. Superplastic behavior (elongation>100%) occurred at a test temperature of 150° C., and at a strain rate$<1\times10^{-3}$/sec. in the as-extruded bar. The combination of low flow stress (25·ksi yield strength) and high ductility (>100%) in the alloys of the invention makes them exceptionally useful in superplastic forming such as hot forging. FIG. 3 shows two extruded bars of $Mg_{92}Zn_2Al_5Nd_1$ forged at 160° C. at a low rate and at 180° C. at a moderate rate. Large cracks occurred when the sample was forged at the moderate rate (0.00021 m/sec.), FIG. 3(*a*). Decreasing the ram speed down to 0.00001 m/sec. eliminates the cracks in the sample and improves the formability, FIG. 3(*b*). The mechanical properties of the as-forged sample is about the same as the as extruded sample, Tables 6, 7. When forged in a close die at a low rate, a complex part may be formed in a single step and with outstanding precision of shape and no cracks. It is to be noted that under the same forging condition severe cracks have been found in the commercial alloy ZK60A.

TABLE 5

The Effect of Temperature and Strain Rate on the Tensile Properties of As Extruded R.S. $Mg_{92}Zn_2Al_{15}Nd_1$ Alloy.

| Test Temp. (°C.) | Strain Rate ($\times 10^{-5}$/sec.) | Y.S. MPa (ksi) | U.T.S. MPa (ksi) | Elong. (%) |
|---|---|---|---|---|
| 20 | 2.5 | 398 (57.8) | 449 (65.3) | 18.0 |
| 20 | 55.0 | 403 (58.6) | 454 (65.9) | 11.7 |
| 20 | 250.0 | 450 (65.4) | 497 (72.2) | 5.4 |
| 50 | 2.5 | 332 (48.3) | 375 (54.5) | 36.1 |
| 50 | 55.0 | 395 (57.4) | 444 (64.5) | 28.4 |
| 50 | 250.0 | 400 (58.1) | 449 (65.3) | 21.3 |
| 100 | 2.5 | 169 (24.5) | 200 (29.1) | 104.5 |
| 100 | 55.0 | 258 (37.5) | 305 (44.3) | 50.3 |
| 100 | 250.0 | 287 (41.7) | 338 (49.1) | 45.8 |
| 150 | 2.5 | 58 (8.5) | 63 (9.1) | 139.6 |
| 150 | 55.0 | 125 (18.2) | 153 (22.2) | 199.8 |
| 150 | 250.0 | 164 (23.8) | 200 (29.1) | 79.4 |

TABLE 6

Room Temperature Tensile Properties of Forged R.S. $Mg_{92}Zn_2Al_5Nd_1$ Extrusion Extruded At Normal Rate.

| Forged Temp. (°C.) | Ram Speed | Cracks | Y.S. MPa (ksi) | U.T.S. MPa (ksi) | Elong. (%) |
|---|---|---|---|---|---|
| 150 | Low | Very Small | 444 (64.5) | 499 (72.5) | 10.2 |
| 180 | Low | None | 451 (65.5) | 505 (73.4) | 12.8 |
| 180 | High | Large | — | — | — |
| 220 | High | None | 451 (65.0) | 516 (75.0) | 13.0 |

TABLE 7

Room Temperature Tensile Properties of Forged R.S. $Mg_{92}Zn_2Al_5Nd_1$ Extrusion Extruded at Low Rate

| Forged Temp. (°C.) | Ram Speed | Cracks | Y.S. MPa (Ksi) | U.T.S. MPa (ksi) | Elong. (%) |
|---|---|---|---|---|---|
| 150 | Low | Very Small | 461 (67.0) | 523 (76.0) | 8.4 |
| 160 | Low | None | 450 (65.4) | 512 (74.4) | 9.1 |
| 190 | Low | None | 484 (70.3) | 540 (78.5) | 6.8 |
| 210 | Low | None | 457 (66.4) | 510 (74.1) | 8.8 |
| 220 | High | Large | — | — | — |
| 230 | High | Small | 469 (68.1) | 536 (77.9) | 7.6 |
| 240 | High | Small | 470 (68.3) | 529 (76.9) | 7.2 |

EXAMPLE 5

A laboratory immersion corrosion test using a solution of 3% sodium chloride in water at 25° C. was conducted to compare the corrosion resistance of magnesium alloys relative to each other. The test conducted was the same as that recommended by ASTM standard G31-72. Samples were cut to a size of about 5.0 cm×5.0 cm×0.5 cm. polished one 600 grit sand paper and degreased by rinsing in acetone. The mass of the sample was weighted to an accuracy of +−0.0001 g. The dimensions of each sample were measured to +−0.01 cm and the total surface area of each specimen was calculated.

After 96 hours immersion, the specimens were taken out, rinsed with water and dried. The corrosion product on the specimen was removed by sequentially dipping the specimens in 200 gms/liter $CrO_3$ and 5 gms/liter $AgNO_3$, for 2 minutes at 80°±5° C., and rinsing the specimens in distilled water. Acetone was used to degrease the specimen before weight measurement. The mass loss due to exposure and the average corrosion rate were calculated. Table 8 compares the corrosion rate for two alloys used in the forming of the present invention with the rate of two commercial alloys AZ91C-HP and ZK60A. The corrosion rate of the alloy $Mg_{91}Zn_2Al_5Y_2$ or $Mg_{92}Zn_2Al_5Nd_1$ is less than that of either of the commercial alloys. Thus, rapidly solidified alloys used in the forming of the present invention not only evidence improved mechanical properties, but also evidence improved corrosion resistance in salt water. The improvement in corrosion resistance may be due to the formation of the protective film on the surface of the sample as the result of a reaction of the saline solution with the rare earth element, or the refined microstructure obtained through rapid solidification.

TABLE 8

Corrosion Behavior of Mg—Zn—Al—X Extrusions Exposed in 3% NaCl Aqueous Solution at 25° C. for 96 hrs.

| Nominal Composition (At %) | Corrosion Rate mil/year |
|---|---|
| $Mg_{91}Zn_2Al_5Y_2$ | 8 |
| $Mg_{92}Zn_2Al_5Nd_1$ | 11 |
| ALLOYS OUTSIDE THE SCOPE OF THE INVENTION | |
| Commercial Alloys | |
| ZK 60 A-T5 ($Mg_{97.7}Zn_{2.1}Zr_{0.2}$) | 104 |
| AZ 91 HP-T6 ($Mg_{91.7}Al_{8.0}Zn_{0.2}Mn_{0.1}$) | 82 |

EXAMPLE 8

A laboratory salt spray (fog) testing using a solution of 5% sodium chloride in distilled water atomized at 35° C. in the PH range of 6.5 to 7.2 was conducted to compare the corrosion resistance of magnesium alloys relative to each other. The testing conducted was the same as that recommended by ASTM standard B-117. The apparatus consists of a fog chamber, a salt solution reservoir, a supply of suitably conditioned compressed air, one atomizing nozzle, specimen supports, provision for heating the chamber, and means of control. Samples were cut to a size of about 5.0 cm.×5.0 cm.×0.5 cm. polished on a 600 grit sand paper and degreased by rinsing in acetone. The mass of the sample was weighted to an accuracy of +−0.0001 g. The dimensions of each sample were measured to +−0.01 cm. and the total surface area of each specimen was calculated.

After every seven days exposure, the specimens were taken out, rinsed with water and dried. The corrosion product was removed by sequentially dipping the specimens in 200 gm/liter $CrO_3$ and 5 gm/liter $AgNO_3$ for 2 minutes at 80°±5° C., and rinsing the specimens in distilled water. Acetone was used to degrease the specimen before weight measurement. The mass loss due to exposure was calculated.

FIG. 4 compares the % weight loss for two magnesium base alloys extruded at three different ranges of temperatures [low temperature (LT), medium temperature (MT) and high temperature (HT) with a commercial corrosion resistant magnesium alloy AZ91C-HP and aluminum alloy Al 2024.

The weight loss of the alloys used in the forming of the present invention extruded at temperatures ranging from 200° C. to 300° C. is less than that of commercial alloy AZ91C-HP. For a given alloy, increasing the extrusion temperature tends to increase the weight loss. For example, the % weight loss of alloy $Mg_{91}Zn_2Al_5Y_2$ extruded at a low temperature is smaller than that extruded at a high temperature and very close to that of Al 2024. Thus, rapidly solidified alloys used in the forming of the present invention not only exhibit improved mechanical properties, but also improved corrosion resistance in saline environment. The improvement in corrosion resistance may be due to the formation of the protective film on the surface of sample as a result of a reaction of the salt fog with the rare earth element, and the inertness of magnesium-, or aluminum- rare earth intermetallic phase, together with the refined microstructure obtained through rapid solidification.

What is claimed is:

1. A superplastic forming produced from a consolidated metal article, said article having been made by compacting a rapidly solidified magnesium based alloy powder consisting of the formula $Mg_{bal}Al_aZn_bX_c$, wherein X is at least one element selected from the group consisting of manganese, cerium, neodymium, praseodymium, and Yttrium, "a" ranges from about 0 to 15 atom percent, "b" ranges from about 0 to 5 atom percent, "c" ranges from about 0.2 to 3 atom percent, the balance being magnesium and incidental impurities, with the proviso that the sum of aluminum and zinc present ranges from about 2 to 15 atom percent, said alloy having a microstructure comprised of a substantially uniform cellular network solid solution phase of a size ranging from 0.2–1.0 micron together with precipitates of magnesium and aluminum containing intermetallic phases of a size less than 0.1 micron, and said forming having been produced at a forming rate ranging from 0.00021 m/sec to 0.00001 m/sec.

2. A superplastic forming as recited in claim 1, having an ultimate tensile strength of at least about 378 MPa.

3. A superplastic forming as recited in claim 1, having a Rockwell B hardness of at least 55.

4. A superplastic forming as recited in claim 1, said superplastic forming comprising a sabot.

* * * * *

UNITED STATES PATENT AND TRADEMARK OFFICE

CERTIFICATE OF CORRECTION

PATENT NO. : 4,938,809

DATED : July 3, 1990

INVENTOR(S) : S.K. Das et al.

It is certified that error appears in the above-identified patent and that said Letters Patent is hereby corrected as shown below.

TITLE PAGE: SUPERPLASTIC FORMING CONSOLIDATED RAPIDLY SOLIDIFIED, MAGNESTUM BASE METAL ALLOY POWDER" should read -- SUPERPLASTIC FORMING FROM CONSOLIDATED, RAPIDLY SOLIDIFIED, MAGNESIUM BASE METAL ALLOY POWDER --.

Abstract, lines 20-21: "good at room ductility temperature" should read -- good ductility at room temperature --.

Col. 3, line 5: After "surfaces" add a semi-colon.

Col. 5, line 21: "0.07 pm" should read -- 0.07 μm --.

line 49: After "obtained" add a period.

Col. 13, line 16: "Yttrium" should read -- yttrium --.

Signed and Sealed this

Twenty-second Day of October, 1991

*Attest:*

HARRY F. MANBECK, JR.

*Attesting Officer*

*Commissioner of Patents and Trademarks*